US009932529B2

(12) United States Patent
Raman et al.

(10) Patent No.: US 9,932,529 B2
(45) Date of Patent: Apr. 3, 2018

(54) PROCESS FOR MANUFACTURING OF RUBBER PROCESS OILS WITH EXTREMELY LOW CARCINOGENIC POLYCYCLIC AROMATICS COMPOUNDS

(71) Applicant: Indian Oil Corporation Ltd., Kolkata, West Bengal (IN)

(72) Inventors: Naduhatty Selai Raman, Faridabad (IN); Palvannan Mohanasundaram, Faridabad (IN); Pattathilchira Varghese Joseph, Faridabad (IN); Pankaj Bhatnagar, Faridabad (IN); Deepak Saxena, Faridabad (IN); Anil Yadav, Faridabad (IN); Vivekanand Kagdiyal, Faridabad (IN); Brijesh Kumar, Faridabad (IN); Rajan Thomas Mookken, Faridabad (IN); Santanam Rajagopal, Faridabad (IN); Ravinder Kumar Malhotra, Faridabad (IN)

(73) Assignee: INDIAN OIL CORPORATION LTD., Kolkata (IN)

( * ) Notice: Subject to any disclaimer, the term of this patent is extended or adjusted under 35 U.S.C. 154(b) by 832 days.

(21) Appl. No.: 14/387,205

(22) PCT Filed: Feb. 2, 2013

(86) PCT No.: PCT/IB2013/051125

§ 371 (c)(1),
(2) Date: Sep. 22, 2014

(87) PCT Pub. No.: WO2013/140272

PCT Pub. Date: Sep. 26, 2013

(65) Prior Publication Data

US 2015/0068951 A1 Mar. 12, 2015

(30) Foreign Application Priority Data

Mar. 23, 2012 (IN) ..... 334/KOL/2012

(51) Int. Cl.

| | |
|---|---|
| ***C10G 53/06*** | (2006.01) |
| ***C10G 21/14*** | (2006.01) |
| ***C10G 21/20*** | (2006.01) |
| ***C10G 21/00*** | (2006.01) |

(52) U.S. Cl.

CPC ..... *C10G 53/06* (2013.01); *C10G 21/003* (2013.01); *C10G 21/14* (2013.01); *C10G 21/20* (2013.01); *C10G 2300/30* (2013.01); *C10G 2300/44* (2013.01)

(58) Field of Classification Search

CPC ..... C10G 53/06; C10G 21/003; C10G 21/14; C10G 21/20

See application file for complete search history.

(56) References Cited

U.S. PATENT DOCUMENTS

| | | | |
|---|---|---|---|
| 5,034,119 | A | 7/1991 | Blackburn et al. |
| 5,504,135 | A | 4/1996 | Ardrizzi et al. |
| 6,103,808 | A | 8/2000 | Hashimoto |
| 6,146,520 | A | 11/2000 | Gupte et al. |
| 6,248,929 | B1 | 6/2001 | Kaimai et al. |
| 6,399,697 | B1 | 6/2002 | Takasaki et al. |
| 6,410,816 | B2 | 6/2002 | Takasaki et al. |

(Continued)

FOREIGN PATENT DOCUMENTS

| | | |
|---|---|---|
| CN | 101691427 B | 1/2012 |
| EP | 1 031 621 B1 | 4/2012 |

(Continued)

OTHER PUBLICATIONS

Exxon Mobil Refining and Supply Company, http://cdn.exxonmobil.com/~/media/global/files/crude-oil-sales/curde_oil_basrah_assay_pdf_new.pdf, retrieved Oct. 2017.

Srivastava, Manoj, Lubricating Base Oil Production, http://docplayer.net/24019703-Lubricating-base-oil-production-technology-overview.html, retrieved Oct. 2017.

*Primary Examiner* — Brian A McCaig
(74) *Attorney, Agent, or Firm* — Maschoff Brennan

(57) ABSTRACT

The invention discloses a rubber process oil and a process for manufacturing rubber process oils which are non-carcinogenic in nature. The process comprises of selectively producing Hildebrand solubility components enriched vacuum residue by selective distillation of reduced crude oil (RCO) to obtain minimum of 10 vol % boiling components in the range 490° C. to 50° C., which leads to higher solubility of rubber process oil with an aniline point of less than 70° C. and with extremely low concentration of selective polycyclic aromatics which makes the 15 product non-carcinogenic. The process comprises of selectively enriching higher Hildebrand solubility components in vacuum residue by vacuum distillation of reduced crude oil (RCO), then subjecting the enriched vacuum residue to solvent deasphalting process and subjecting the deasphalted oil to aromatic extraction process and then blending the enriched aromatic extract with Heavy Alkyl 20 Benzene (HAB) or Solvent processed base oil or hydroprocessed base oil or mixture thereof. The rubber process oils manufactured by the invented process have a polycyclic aromatics (PCA) content of less than 10 ppm, specifically benzo(a)pyrene content of less than 1 ppm. They have aniline point less than 70° C. but have high kinematic viscosity of 25 to 75 cSt at 100° C., pour point of 27° C. or less and a flash point minimum of 250° C. or more.

10 Claims, No Drawings

(56) References Cited

U.S. PATENT DOCUMENTS

| | | | | |
|---|---|---|---|---|
| 6,878,263 | B2 | 4/2005 | Kaimai et al. | |
| 2009/0020453 | A1 | 1/2009 | Tanaka et al. | |
| 2010/0243533 | A1 | 9/2010 | Raman et al. | |
| 2011/0005976 | A1* | 1/2011 | Rispoli | C10G 1/06 208/390 |
| 2011/0237471 | A1* | 9/2011 | Singh | C10M 169/04 508/154 |
| 2013/0150637 | A1* | 6/2013 | Borremans | B01J 31/2295 585/241 |
| 2015/0126770 | A1* | 5/2015 | Sohn | C07C 6/126 562/94 |

FOREIGN PATENT DOCUMENTS

| | | | |
|---|---|---|---|
| GB | 1 390 953 | A | 4/1975 |
| GB | 2 257 156 | A | 1/1993 |

* cited by examiner

PROCESS FOR MANUFACTURING OF RUBBER PROCESS OILS WITH EXTREMELY LOW CARCINOGENIC POLYCYCLIC AROMATICS COMPOUNDS

FIELD OF THE INVENTION

The present invention relates to process oils in general, and to a rubber process oils with extremely low carcinogenic polycyclic aromatics compounds in particular. The rubber process oil made according to the process of the present invention are free from toxicity and carcinogenicity due to extremely low concentration of selective polycyclic aromatics present in the oil.

BACKGROUND OF THE INVENTION AND ITS PRIOR ART

Process oils are hydrocarbon mixtures that boil in the same temperature range as lubricant base oils and are derived from petroleum distillates by solvent extraction. However, unlike lubricant base oils which are rarely employed outside the lubricant field, process oils have a wide range of industrial applications which include using them as a rubber process oil (RPO), ink process oil etc. These oils invariably come in contact with their users who are exposed to the ill effects of their toxicity and other harmful properties. Therefore, to make process oils suitable for these applications, the compositions of process oils have to be carefully controlled during refining.

U.S. Pat. No. 5,034,119 claims bright stock extract and deasphalted oil substantially free from mutagenic activity with mutagencity index less than 1.0. Further the invention was limited to mutagenic index and its relationship with a physical property (boiling point). However, it has not discussed the process for producing rubber process oil and the critical properties required including solvency characteristics such as aniline point and/or hydrocarbon composition and flowability in terms of viscometrics or pour point.

The present invention discloses a method of producing processing oils which contain extremely low concentration of selective polycyclic aromatics. The process comprises of selectively producing vacuum residue with negligible amount of polycyclic aromatics compounds and subsequent deasphalting and extraction followed by suitable blending with heavy alkyl benzene or hydroprocessed base oil or solvent processed base oil or mixture thereof to produce rubber process oils with better solvency characteristics as indicated by aniline point which is less than 70° C. and pour point of less than 27° C.

In U.S. Pat. No. 5,504,135, dewaxed deasphalted oil is used as RPO which has aniline point less than 97° C. However, in the present invention, the process oil is a blend of bright neutral (BN) extract with HAB or hydroprocessed or solvent processed base oil or mixture thereof with aniline point of less than 70° C. U.S. Pat. Nos. 6,248,929 and 6,878,263 discuss about RPO production employing a process with two stage extraction. U.S. Pat. No. 6,146,520 claims selective reextraction process for reducing the mutagenicity Index to less than 1 by using of two different solvents. However the present invention deals with production of vacuum residue containing low carcinogenic PCA compounds followed by solvent extraction and blending with suitable hydrocarbon streams to produce RPO.

In U.S. Pat. No. 6,103,808, high aromatic oil is used as RPO which has aniline point 97° C. or less. However, it does not disclose the selective carcinogenic PCA content. RPO produced in the present invention is having an aniline point less than 70° C. and selective carcinogenic PCA content of less than 10 ppm.

In U.S. Pat. No. 6,399,697, residual oil is mixed with lubricant base oil and then mixture is extracted with a solvent to get a product with low PCA content satisfying the RPO requirements but not disclosing the selective carcinogenic PCA content and Aniline point.

In U.S. Pat. No. 6,410,816, the RPO was produced by mineral oil extraction by using a polar solvent. The extract (40-97%) was blended with base oil (3-60%). In this process deasphalting process was not involved and process conditions are not disclosed. Further in the present invention, selective carcinogenic PCA content is less than 10 ppm.

U.S. Pat. No. 7,972,496 deals with the manufacturing of process oil by mixing extract of deasphalted oil with lubricant base oil with a volume ratio of 95/5 to 60/40. The process oil has aniline point of 90° C. or less with selective carcinogenic PCA content: benzo(a)pyrene content of 1 mass ppm or less; specified aromatic compound content of 10 mass ppm or lower.

The present invention comprises process for producing rubber process oil with selectively producing higher Hildebrand solubility components enriched vacuum residue by selective distillation of Reduced Crude Oil (RCO) to obtain minimum of 10 vol % boiling components in between 490° C. to 550° C.; which leads to higher solubility of rubber process oil with an aniline point of less than 70° C. and higher hildebrand components enriched vacuum residue containing extremely low carcinogenic polycyclic aromatics followed by solvent deasphalting to produce deasphalted oil and then solvent extraction to produce higher Hildebrand solubility components enriched bright neutral extract which then suitably blended with heavy alkyl benzene to produce the process oil having a specified aromatic compound content of 10 mass ppm or lower and benzo(a)pyrene content of 1 mass ppm or less; and further the aniline point of the resultant process oil is 70° C. or less.

European Patent EP1031621 discloses a process for producing process oil by extraction of premixed deasphlated oil with lubricating base oil.

However, the present invention is based on vacuum distillation to selectively produce enriched hildebrand solubility components in vacuum residue which on subsequent processing in deasphalting unit and extraction unit will result in enriched higher soluble process oil with aniline point less than 70° C. as well as benzopyrene content less than 1 ppm.

Chinese Patent CN101691427 discloses a blending of deasphalted oil with naphthenic oil for producing environment-friendly rubber oil having no toxicity and no carcinogenic effects.

However, it does not disclose the critical step of selectively producing enriched hildebrand solubility components in vacuum residue by selective distillation of Reduced Crude Oil (RCO) which leads to higher solubility of rubber process oil with an aniline point of less than 70° C., on subsequent processing in deasphalting and extraction units, with extremely low carcinogenic polycyclic aromatic components.

U.S. Pat. No. 5,034,119 discloses only on mutagenicity index and not disclosed on the solubility and performance indicator such as aniline point less than 70° C.

It does not disclose the critical step of selectively producing enriched hildebrand solubility components in vacuum residue by selective distillation of reduced crude oil (RCO) to obtain minimum of 10% volume recovery boiling components in between 490° C. to 550° C. which leads to higher solubility of rubber process oil with an aniline point of less than 70° C., on subsequent processing in deasphalting and extraction units, with extremely low carcinogenic polycyclic aromatic components.

None of the above disclosures discussed about production of vacuum residue with enriching Hildebrand solubility parameter by produced it with a minimum 10% volume recovery of the boiling components being in the range between 490° C. to 550° C. which increases solubility of rubber process oil with aniline point of less than 70° C., on subsequent processing in deasphalting and extraction units, with extremely low carcinogenic polycyclic aromatic components.

SUMMARY OF THE INVENTION

The present invention discloses a rubber process oil with extremely low carcinogenic polycyclic aromatics compounds and a process of manufacturing thereof. The process comprises of selectively enriching higher Hildebrand solubility components in vacuum residue by vacuum distillation of reduced crude oil (RCO), to obtain minimum of 10 vol % boiling components in between 490° C. to 550° C.; which leads to higher solubility of rubber process oil with an aniline point of less than 70° C. and with extremely low concentration of selective polycyclic aromatics. The enriched vacuum residue obtained undergoes solvent deasphalting process and the deasphalted oil is subjected to aromatic extraction process to yield the rubber process oil.

The rubber process oils produced by the invented process have selective polycyclic aromatics (PCA) content of less than 10 ppm and specifically benzo(a)pyrene content of less than 1 ppm.

OBJECTS OF THE INVENTION

An object of the present invention is to provide a rubber process oils with extremely low content of harmful carcinogenic compounds without compromising the physical properties of the oil and a process for manufacturing the same.

Yet another object of the present invention is to provide a process for producing a process oil which has higher solubility with an aniline point of less than 70° C.

A further object of the present invention is to provide a process for manufacturing oils that are rich in aromatic hydrocarbons but having selective polycyclic aromatic content less than 10 ppm by mass and specifically benzo(a) pyrene content of less than 1 ppm.

Another object of the present invention is to provide a process for manufacturing oils having a high kinematic viscosity of 25 to 75 cSt at 100° C., a flash point minimum of 250° C. or more, pour point more preferably less than 27° C. and a $C_a$ content of more than 25 wt %.

DESCRIPTION OF THE INVENTION

Process oils are the hydrocarbon mixture that boils in the same temperature range as lubricant base oils and are derived from petroleum distillates by solvent extraction. However, unlike lubricant base oils which are rarely employed outside the lubricant field, process oils have a wide range of industrial applications which include using it as rubber process oil (RPO), ink process oil etc. To make it suitable for these applications, the compositions of process oils have to be carefully controlled during refining.

Rubber process oil is employed during rubber processing for reducing the mixing temperature, prevent scorching and to decrease the viscosity of the rubber, thereby facilitating the milling operations and general workability of the rubber compound and to aid the dispersion of fillers and modify the physical properties of rubber compounds.

The rubber process oil should have higher degree of miscibility or solubility with rubber to act as good process oil. Hildebrand solubility parameter of the hydrocarbon oil is employed in the present invention to measure solubility of oil, which is further experimentally measured by aniline point. Lower the aniline point better is the solubility of the hydrocarbon oil.

The Hildebrand solubility parameter can be derived from the heat of vaporization of the component. Further it describes the total cohesive energy density of component.

$$\text{Solubility parameter } (\delta)=(\blacktriangle H-RT)/V_m)^{0.5}$$

where ▲H—Heat of vaporization, R—Gas Constant, T—Absolute temperature in Kelvin and $V_m$—Molar volume.

A component with a higher Hildebrand value will have higher solubility and more particularly in the present invention, higher Hildebrand oil dissolves rubber better. Hereinafter, higher Hildebrand parameter enriched Bright Neutral (BN) extract is called as "enriched BN extract"

The aniline point is defined as the minimum temperature at which 50:50 (v/v) mixture of oil and aniline forms a homogenous phase. Below that temperature, the aniline/oil phase separation occurs. The aniline point decreases with an increasing Hildebrand value of the component. The rubber process oil should have strong molecular cohesion between oil and rubber component and therefore requires relatively higher Hildebrand value or lesser aniline point.

Typically, rubber process oil is used for processing of natural rubber, butadiene styrene rubber, butadiene nitrile rubber (SCN 18, SCN 26, SCN 40), butyl rubber, neoprene rubber, poly isoprene rubber, epoxy diane resin etc. The typical Hildebrand solubility parameter values of some of the rubber are shown below:

| Type of rubber | Hildebrand Solubility Parameter $(MPa)^{0.5}$ |
|---|---|
| Natural rubber | 18.1 |
| Butadiene nitrile rubber | |
| a) SCN 18 | 19.2 |
| b) SCN 26 | 19.6 |
| c) SCN40 | 20.2 |
| Butadiene styrene rubber | 19.3 |
| Butyl rubber | 17.9 |
| Neoprene | 19.6 |
| Poly isoprene | 18 |
| Epoxy diane resin | 21.5 |

Typically, rubber components have a solubility parameter in the range of 18 to 24 $(MPa)^{0.5}$. Consequently, a substance with a matching solubility parameter should have better miscibility with the rubber.

The present invention provides a process for manufacture of a process oil, which has relatively higher Hildebrand solubility components to obtain higher solubility with rubber components having their aniline point less than 70° C. and which have extremely low content of harmful carcinogenic compounds without compromising the physical properties of the oil.

In one embodiment of the present invention, the higher Hildebrand value enriched vacuum residue is produced with a minimum 10% volume recovery of the boiling components being in the range between 490° C. to 550° C. to obtain higher solubility of rubber process oil with an aniline point of less than 70° C.

In another embodiment, the invention provides a process for manufacturing a process oil, the process comprises selectively producing enriched hildebrand solubility components in vacuum residue by selective distillation of reduced crude oil (RCO) to obtain higher solubility of rubber process oil with the aniline point less than 70° C. and the enriched vacuum residue containing extremely low carcinogenic polycyclic aromatics. The enriched vacuum residue with low level of selective PCA content is further subjected to propane deasphalting process. The volume ratio of propane solvent to vacuum residue is kept in the range of 6-8 and the operating temperature between 55-65° C.

Further, the above said Hildebrand solubility components enriched deasphalted oil or bright neutral (BN) feedstock is subjected to extraction with a solvent having selective affinity for aromatic hydrocarbon, which can be Furfural or N-Methyl Pyrrolidone (NMP) alongwith a cosolvent and the cosolvent is preferably selected from formamide, n-methyl formamide or n,n-dimethyl formamide in which the cosolvent content is preferably less than 30 wt %.

The solvent to DAO ratio was kept at 1.5-2.5 wt %, preferably at 2.25 wt % and the operating temperature was is in the range of 80-90° C. The said enriched BN extract obtained from the extraction process has a selective polycyclic aromatic content [Benz(a)anthracene+chrysene, Benz (j)floranthene, Benz(e)pyrene, Benz(b)floranthene, Benz(K) floranthene, Benz(a)pyrene) and Dibenz(a,h)anthracene] of less than 10 ppm and specifically, Benz(a)pyrene content less than 1 ppm as measured by high pressure liquid chromatography (HPLC) technique and aniline point 70° C. or less, but the process oil has a high kinematic viscosity and pour point. For reducing the kinematic viscosity and pour point the higher Hildebrand solubility components enriched BN extract is blended with heavy alkyl benzene (HAB) or HAB with solvent processed base oil or HAB with hydro processed base oil or mixture thereof.

According to the present invention, the sum total of the selective polycyclic aromatic content [Benzo(a) anthracene+ chrysene, Benzo(j)floranthene, Benzo(e)pyrene, Benzo(b) floranthene, Benzo(K)floranthene, Benzo(a)pyrene) and Dibenzo(a,h)anthracene] of rubber process oil measured by high pressure liquid chromatography (HPLC) technique is less than 10 ppm mass and benz (a) pyrene content less than 1 ppm mass, the aniline point is 70° C. or less and the % $C_a$ value as determined by ring analysis is minimum 25%.

In the present invention, a process for manufacturing the process oil is disclosed, which comprises of:

a) selectively enriching higher hildebrand solubility components in vacuum residue by vacuum distillation of reduced crude oil (RCO) to obtain process oil having higher solubility with an aniline point less than 70° C. The vacuum residue is produced with a minimum 10% volume recovery of the boiling components being in the range between 490° C. to 550° C. preferably in the range between 500° C. to 550° C.
b) subjecting the enriched vacuum residue to solvent deasphalting process to produce deasphalted oil; In the deasphalting process, propane is a solvent, in which operating temperature range is between 55° C. to 90° C. and propane to feed volume ratio is 4 to 14.
c) further subjecting the deasphalted oil produced to aromatic extraction process to produce enriched aromatic extract with higher solubility;
d) finally blending the enriched aromatic extract with heavy alkyl benzene (HAB) or hydro processed base oil or solvent processed base oil or mixture thereof to produce the rubber process oils.

The rubber process oils so produced have a polycyclic aromatics (PCA) content of less than 10 ppm, specifically benzo(a)pyrene content of less than 1 ppm. and aniline point less than 70° C. but have a high kinematic viscosity of 25 to 75 cSt at 100° C., pour point of 27° C. or less and has a flash point minimum of 250° C. or more.

According to the present invention, the deasphalted oil is subjected to aromatic extraction, in which N-Methyl pyrrolidone is a solvent, with water as antisolvent or alternatively alongwith a cosolvent and the cosolvent is preferably selected from formamide, n-methyl formamide, n,n-dimethyl formamide in which the cosolvent content is preferably less than 30 wt %.

In this process the aromatic extract content of the process oil is in the range of 70 wt % to 99 wt % and the heavy alkyl benzene (HAB) content is in the range of 1 to 10 wt %. The selective polycyclic aromatics as determined by high pressure liquid chromatography is preferably less than 10 ppm (mass).

The total polycyclic aromatics content of the process oil comprising of Benzo(a)anthracene, chrysene, Benzo(j)floranthene, Benzo(e)pyrene, Benzo(b)floranthene, Benzo(K) floranthene, Benzo(a)pyrene, Dibenzo(a,h)anthracene and Benzo(a)pyrene is less than 10 ppm. The Benzo(a)pyrene content is less than 1 ppm.

The present invention directed to a process for manufacturing a process oil which has low levels of selective polycyclic aromatic content. In one of its embodiments, the present invention provides the process for producing a process oil having low level of selective PCA content from hydrocarbon oil and more particularly selectively producing vacuum residue with negligible amount of PCA compounds by vacuum distillation of reduced crude oil (RCO), the above said vacuum residue is further subjected to propane deasphalting process. The volume ratio of propane solvent to vacuum residue is kept in the range of 6-8 and the operating temperature between 55-65° C.

Further, the above said deasphalted oil (BN) is subjected to extraction with a solvent having selective affinity for aromatic hydrocarbon like Furfural or N-Methyl Pyrrolidone (NMP) alongwith a cosolvent and the cosolvent is preferably selected from formamide, n-methyl formamide, n,n-dimethyl formamide in which the cosolvent content is preferably less than 30 wt %.

The solvent to DAO (BN) ratio was kept at 1.5-2.5 wt % preferably at 2.25 wt % and the operating temperature was is in the range of 80-90° C. The above BN extract obtained from the extraction process has a selective polycyclic aromatic content [Benz(a)anthracene+chrysene, Benz(j)floranthene, Benz(e)pyrene, Benz(b)floranthene, Benz(K)floranthene, Benz(a)pyrene) and Dibenz(a,h)anthracene] of less than 10 ppm and specifically, Benz(a)pyrene content less than 1 ppm as measured by high pressure liquid chromatography (HPLC) technique and aniline point 70° C. or less but the process oil having the high kinematic viscosity and pour point. For reducing the kinematic viscosity and pour point the BN extract is blended with solvent processed base oil or hydro processed base oil or heavy alkyl benzene (HAB) or mixture thereof.

In a preferred embodiment of the present invention, the solvent processed base oil is blended with BN extract. The ratio of solvent processed base oil blended with above said BN extract is in the range of 1 to 30 wt % preferably 1 to 10 wt %. The selected base oil boiling point is in the range of 300-550° C.

In another embodiment of the present invention, hydro processed base oil is blended with BN extract in the range of 1 to 30 wt %, preferably 1 to 10 wt %. The selected hydro processed base oil boiling point is in the range of 300-500° C.

In one more embodiment of the present invention, heavy alkyl benzene (HAB) is blended with BN extract in the range of 1 to 30 wt %, preferably 1 to 10 wt %.

In yet another embodiment of the present invention, the process oil has a selective polycyclic aromatic content [Benzo(a) anthracene+chrysene, Benzo(j)floranthene, Benzo(e)pyrene, Benzob)floranthene, Benzo(K)floranthene, Benzo(a)pyrene) and Dibenzo(a,h)anthracene] of less than 10 ppm mass and Benzo(a)pyrene content less than 1 ppm mass as measured by high pressure liquid chromatography (HPLC) technique. It has the following properties:

(a) Aniline point is 70° C. or less
(b) The pour point of 30° C. or less
(c) $C_a$ content is more than 25 wt %
(d) The kinematic viscosity within the range of 25 cSt to 75 cSt
(e) The flash point is 250° C. or more

EXAMPLE 1

Vacuum residue is selectively produced with negligible amount of PCA compounds by distilling of reduced crude oil (RCO) under reduced pressure. The vacuum residue is produced with a minimum 10% volume recovery of the boiling components being in the range between 490° C. to 550° C. The vacuum residue is further subjected to propane deasphalting process with eight parts by volume of propane added to one part by volume of vacuum residue with column top and bottom temperatures of 65° C. and 55° C. The deasphalted oil from above process is further subjected to aromatic extraction with NMP solvent in counter current extractor with top and bottom temperature of 90° C. and 80° C. and keeping solvent to oil ratio (volume/volume) at 2.25. The BN extract so produced is of higher pour point and kinematic viscosity. To reduce the kinematic viscosity and pour point, the heavy alkyl benzene (HAB) is blended with BN extract. The BN extract blend has a selective polycyclic aromatic content of less than 10 ppm and is used as rubber process oil 2. The other properties of process oil-A are shown in Table 1.

TABLE 1

Properties of process oil-C (RPO-3) derived from blending of BN extract with heavy alkyl benzene (HAB).

| S. No. | Property | Process Oil A |
|---|---|---|
| 1 | Appearance @ 40° C. | Dark liquid |
| 2 | Density @15° C. (g/cc) | 0.986 |
| 3 | Kinematic Viscosity@100° C. (cSt) | 76.9 |
| 4 | Refractive Index@20° C. | 1.55567 |
| 5 | Viscosity Gravimetric Constant | 0.8947 |
| 6 | Aniline Point(° C.) | 65.5 |
| 7 | Flash Point (° C.) | 307 |
| 8 | Pour Point (° C.) | 27 |
| 9 | Sulphur, wt % | 3.4 |

TABLE 1-continued

Properties of process oil-C (RPO-3) derived from blending of BN extract with heavy alkyl benzene (HAB).

| S. No. | Property | Process Oil A |
|---|---|---|
| 10 | Hydrocarbon Composition, % wt | |
| | Ca | 28.5 |
| | Cp | 57.9 |
| | Cn | 13.6 |
| 11 | Polycyclic aromatic content (ppm) | 7.22 |
| | Benzo(a)pyrene (ppm) | 0.18 |
| 12 | Distillation data, ASTM D1160 (Vol %) | Temperature, ° C. |
| | IBP , ° C. | 359 |
| | 5% vol recovery | 444 |
| | 10% vol recovery | 503 |
| | 30% vol recovery | 555 |
| | 50% vol recovery | 580 |
| | 70% vol recovery | 605 |
| | 90% vol recovery | — |
| | FBP, ° C. | — |

EXAMPLE 2

Vacuum residue is selectively produced with negligible amount of PCA compounds by distillation of reduced crude oil (RCO) under reduced pressure. The vacuum residue is produced with a minimum 10% volume recovery of the boiling components being in the range between 490° C. to 550° C. The vacuum residue is further subjected to propane deasphalting process with eight parts by volume of propane added to one part by volume of vacuum residue with column top and bottom temperatures of 65° C. and 55° C. The deasphalted oil from above process is further subjected to aromatic extraction with NMP solvent in counter current extractor with top and bottom temperature of 90° C. and 80° C. and solvent to oil ratio (volume/volume) being kept at 2.25. The BN extract so produced is of higher pour point and kinematic viscosity. The solvent processed base oil is then blended with solvent processed base oil to reduce kinematic viscosity and pour point. The selected solvent processed base oil has the boiling range which lies between 300° C.-550° C. The BN extract blend has a selective polycyclic aromatic content less than 10 ppm mass and is used as rubber process oil-B. The other properties of Process oil-B are shown in Table 2.

TABLE 2

Properties of process oil-A (RPO-1) derived from blending of BN extract with solvent processed base oil.

| S. No. | Property | Process Oil B |
|---|---|---|
| 1 | Appearance @ 40° C. | Dark liquid |
| 2 | Density @15° C. (g/cc) | 0.9785 |
| 3 | Kinematic Viscosity@100° C. (cSt) | 74.6 |
| 4 | Refractive Index@20° C. | 1.55013 |
| 5 | VGC | 0.8849 |
| 6 | Aniline Point(° C.) | 69.9 |
| 7 | Flash Point (° C.) | 305 |
| 8 | Pour Point (° C.) | (+)27 |
| 9 | Sulfur Content (% wt) | 3.7 |
| 10 | Hydrocarbon Composition, % wt | |
| | Ca | 27.41 |
| | Cp | 60.67 |
| | Cn | 11.91 |
| 11 | Polycyclic aromatic content (ppm) | 4.79 |
| | Benzo(a)pyrene (ppm) | 0.4 |
| 12 | Distillation data, ASTM D1160 (Vol %) | |
| | IBP | 386 |
| | 5 | 465 |

TABLE 2-continued

Properties of process oil-A (RPO-1) derived from blending of BN extract with solvent processed base oil.

| S. No. | Property | Process Oil B |
|---|---|---|
| | 10 | 528 |
| | 30 | 559 |
| | 50 | 589 |
| | 60 | 610 |
| | 70 | 612 |
| | 90 | |
| | FBP | — |

EXAMPLE 3

Vacuum residue is selectively produced with negligible amount of PCA compounds by distilling reduced crude oil (RCO) under reduced pressure. The vacuum residue is produced with a minimum 10% volume recovery of the boiling components being in the range between 490° C. to 550° C. The vacuum residue is further subjected to propane deasphalting process with eight parts by volume of propane being added to one part by volume of vacuum residue and with column top and bottom temperatures of 65° C. and 55° C. The deasphalted oil from above process is further subjected to aromatic extraction with NMP solvent in counter current extractor with top and bottom temperature of 90° C. and 80° C. and solvent to oil ratio (volume/volume) being kept at 2.25. The BN extract so produced is of higher pour point and kinematic viscosity. Hydro processed base oil is blended with this BN extract to reduce kinematic viscosity and pour point. The selected hydro processed base oil has a boiling point range lying between 300° C.-500° C. The BN extract blend has a selective polycyclic aromatic content of less than 10 ppm and is used as Process oil-C. The other properties of process oil-C are shown in Table 3.

TABLE 3

Properties of process oil-B (RPO-2) derived from blending of BN extract with hydro processed base oil.

| S. No. | Property | Process Oil C |
|---|---|---|
| 1 | Appearance @ 40° C. | Dark liquid |
| 2 | Density @15° C. (g/cc) | 0.9742 |
| 3 | Kinematic Viscosity@100° C. (cSt) | 67.8 |
| 4 | Refractive Index@20° C. | 1.55356 |
| 5 | VGC | 0.8812 |
| 6 | Aniline Point(° C.) | 69.8 |
| 7 | Flash Point (° C.) | 275 |
| 8 | Pour Point (° C.) | (+)27 |
| 9 | Sulfur Content (% wt) | 3.7 |
| 10 | Hydrocarbon composition, % wt | |
| | Ca | 26.68 |
| | Cp | 60.1 |
| | Cn | 13.62 |
| 11 | Polycyclic aromatic content (ppm) | 4.73 |
| | Benzo(a)pyrene (ppm) | 0.76 |
| 12 | Distillation data, ASTM D1160 (Vol %) | |
| | IBP | 350 |
| | 5 | 430 |
| | 10 | 543 |
| | 30 | 570 |
| | 50 | 593 |
| | 60 | 614 |
| | 70 | — |
| | 90 | — |
| | FBP | — |

The invention has been explained in some of its exemplary embodiments. However, there can be other embodiments of the same invention, all of which are deemed covered by this description and the appended claims.

We claim:

1. A process for manufacturing of rubber process oils containing extremely low carcinogenic polycyclic aromatic components less than 10 ppm (mass) specifically benzo(a) pyrene content of less than 1 ppm, and aniline point less than 70° C., comprising:

a) selectively enriching higher Hildebrand solubility components in vacuum residue produced with a minimum 10% volume recovery in the boiling range of 490° C. to 550° C. from reduced crude oil (RCO)

b) subjecting the enriched vacuum residue to solvent deasphalting process to produce the deasphalted oil;

c) subjecting the deasphalted oil to aromatic extraction process with N-methyl pyrolidone (NMP) as solvent in counter current extractor with top and bottom temperature of 90° C. and 80° C. and solvent to oil ratio (volume/volume) being maintained at 2.25 to produce Bright Neutral (BN) extract with higher solubility; and d) blending the Bright Neutral (BN) extract with heavy alkyl benzene (HAB) or hydro processed base oil or solvent processed base oil or a mixture thereof to produce the rubber process oils.

2. The process for manufacturing of rubber process oil as claimed in claim 1, wherein vacuum residue is produced with a minimum 10% volume recovery in the boiling range of 490° C. to 550° C.

3. The process for manufacturing of rubber process oils as claimed in claim 1, wherein the deasphalting process has propane as a solvent with operating temperature range lying between 55° C. to 90° C. and propane to feed volume ratio is 4 to 14.

4. The process for manufacturing of rubber process oils as claimed in claim 1, wherein the aromatic extraction has N-Methyl pyrrolidone as a solvent, with water as antisolvent or alternatively alongwith a cosolvent, the cosolvent being selected from formamide, n-methyl formamide and n,n-dimethyl formamide in which the cosolvent content is less than 30 wt %.

5. The process for manufacturing of rubber process oils as claimed in claim 1, wherein the Bright Neutral (BN) extract content of the process oil is in the range of 70 wt % to 99 wt %, the heavy alkyl benzene (HAB) content is in the range of 1 to 10 wt %, and the selective polycyclic aromatics as determined by high pressure liquid chromatography is less than 10 ppm (mass).

6. The process for manufacturing of rubber process oils as claimed in claim 1, wherein the polycyclic aromatics content of the process oil is less than 10 ppm of Benzo(a)anthracene, chrysene, Benzo(j)floranthene, Benzo(e)pyrene, Benzo(b) floranthene, Benzo(K)floranthene, Benzo(a)pyrene, Dibenzo(a,h)anthracene and Benzo(a)pyrene, wherein the Benzo (a)pyrene content is less than 1 ppm.

7. The process for manufacturing of rubber process oils as claimed in claim 1, wherein the solvent processed base oil is blended with Bright Neutral (BN) extract in the range of 1 to 30 wt %, the solvent processed base oil boiling point being in the range of 300° C.-550° C.

8. The process for manufacturing of rubber process oils as claimed in claim 1, wherein hydro processed base oil is blended with Bright Neutral (BN) extract in the range of 1 to 30 wt %, and the hydro processed base oil boiling point being in the range of 300° C.-500° C.

9. The process for manufacturing of rubber process oils as claimed in claim 1, wherein heavy alkyl benzene (HAB) is blended with Bright Neutral (BN) extract in the range of 1 to 30 wt %.

10. The process for manufacturing of rubber process oils as claimed in claim 1, wherein the process oils so produced have an aniline point less than 70° C.

* * * * *